US005439357A

United States Patent [19]

Barthod et al.

[11] Patent Number: 5,439,357

[45] Date of Patent: Aug. 8, 1995

[54] MAGNETICALLY GUIDED POSITIVE-DISPLACEMENT MACHINE

[75] Inventors: Benoît Barthod, Cran Gevrier; Jean-Pierre Chicherie, Annecy-Le-Vieux; Denis Perrillat-Amede, Annecy, all of France

[73] Assignee: Alcatel Cit, Paris, France

[21] Appl. No.: 190,983

[22] Filed: Feb. 3, 1994

[30] Foreign Application Priority Data

Feb. 19, 1993 [FR] France ..... 93 01926

[51] Int. Cl.[6] ..... F04B 17/00

[52] U.S. Cl. ..... 417/410.3; 418/61.3

[58] Field of Search ..... 417/410.1, 410.3, 420, 417/352, 313, 354; 418/61.3

[56] References Cited

U.S. PATENT DOCUMENTS

| | | | |
|---|---|---|---|
| 1,849,222 | 3/1932 | Canton | 417/410.3 |
| 2,161,374 | 6/1939 | Moineau | 417/410.3 |
| 2,561,890 | 7/1951 | Stoddard | 417/410.1 |
| 2,703,370 | 3/1955 | Steensen | 310/82 |
| 2,761,078 | 8/1956 | McAdam | 310/67 R |
| 2,965,039 | 12/1960 | Morita et al. | 418/166 |
| 3,029,738 | 4/1962 | Clar et al. | 418/159 |
| 3,194,165 | 7/1965 | Sorlin | 417/353 |
| 3,932,069 | 1/1976 | Giardini et al. | 417/420 |
| 3,985,476 | 10/1976 | Hofbauer | 418/61 B |
| 4,111,617 | 9/1978 | Gale et al. | 418/61 B |
| 4,164,690 | 8/1979 | Muller et al. | 318/254 |
| 4,556,376 | 12/1985 | Leroy et al. | 418/1 |
| 4,721,445 | 1/1988 | Hoffmann | 418/61.3 |
| 4,758,132 | 7/1988 | Martwig | 417/353 |
| 4,867,652 | 9/1989 | Gormley | 417/353 |
| 4,924,180 | 5/1990 | Nasr et al. | 417/420 |
| 4,949,022 | 5/1990 | Lipman | 318/254 |
| 5,080,562 | 1/1992 | Barrows et al. | 417/353 |
| 5,127,377 | 7/1992 | Yang | 418/61.3 |
| 5,145,329 | 9/1992 | Zumousch et al. | 417/356 |

FOREIGN PATENT DOCUMENTS

| | | |
|---|---|---|
| 0504863A1 | 9/1992 | European Pat. Off. . |
| 383332 | 3/1908 | France . |
| 2203421 | 4/1979 | France . |

*Primary Examiner*—Timothy S. Thorpe
*Assistant Examiner*—Peter G. Korytnyk
*Attorney, Agent, or Firm*—Sughrue, Mion, Zinn, Macpeak & Seas

[57] ABSTRACT

A positive-displacement machine comprising a piston situated in a casing. The outline of the piston is hypertrochoidal, as is the outline of the hollow inside volume of the casing. The piston has n axes of symmetry, and the casing has n+1 axes of symmetry. The piston rotates inside the casing in orbital motion about the axis Δc of the casing. To obtain the rotation in orbital motion, firstly the piston is freely rotatably mounted on a crank pin that has its axis offset relative to the axis of a supporting shaft that is coaxial with the axis Δc of the casing, the shaft being rotated, and secondly the surface of the piston and the surface of the hollow inside volume of the casing are equipped with permanent magnets creating magnetic repulsion forces.

20 Claims, 8 Drawing Sheets

MAGNETICALLY GUIDED POSITIVE-DISPLACEMENT MACHINE

FIELD OF THE INVENTION

The present invention relates to a positive-displacement machine such as a vacuum pump or a compressor.

In particular, the invention applies to a dry low-throughput vacuum pump that does not pollute, and that is capable of delivering the pumped gas at atmospheric pressure.

BACKGROUND OF THE INVENTION

Roots pumps, claw pumps, and double-screw pumps are known, but those machines include two shafts that are synchronized in rotation by gears that are lubricated and are therefore not entirely dry.

Spiral pumps referred to as "scroll pumps" are also known, but they are expensive because it is difficult to obtain the very accurate outline that is required for the spirals. Furthermore, they cannot pump condensates.

Dry vane pumps are also known, but the vanes wear quickly and give rise to considerably lower performance levels, and short pump life, and the vacuum chamber is polluted by the wear products. Diaphragm pumps are also known, but the diaphragms have a short life, and piston pumps are known, but they have low performance levels and high noise and vibration levels.

The invention relates to a new type of dry primary pump which enables most of the problems and drawbacks of known dry primary pumps to be overcome. The new type of pump is a positive-displacement machine having orbital motion and being hypertrochoidal in geometrical shape.

The machine comprises a cylindrical piston, a cylindrical casing surrounding the piston, and a crank shaft whose axes are parallel to those of the cylinders delimiting the shapes of the piston and of the casing, the crank shaft being in rotary relation with the piston and with the casing.

The term "cylindrical" is used herein in its broad mathematical sense; with neither the piston nor the casing necessarily being in the form of a right circular cylinder. In particular, in that machine, the cylinder defining the shape of the piston has an order of symmetry about its axis equal to $S_p$, whereas the cylinder of the casing has an order of symmetry equal to $S_c$; with $S_p$ and $S_c$ being chosen so that they differ from each other by unity. Furthermore, the geometrical shapes of the piston and of the casing are chosen so that the two elements correspond directly to each other.

One of the elements (i.e. the casing or the piston) has an outline $P_1$ which corresponds to a curve uniformly distant from a closed hypertrochoid, having no crunodes and no cusps, excluding hypertrochoids that are degraded into hypotrochoids, epitrochoids, or peritrochoids. The outline $P_1$ may also be at zero distance from such a hypertrochoid, and may therefore correspond thereto. Hypertrochoids are defined in French Patent 2,203,421. The other element has an outline $P_2$ which is the envelope of $P_1$ in relative orbital motion defined by two circles $C_1$ and $C_2$ having respective centers and radii ($O_1$, $R_1$) and ($O_2$, $R_2$), the circles being respectively secured to the outlines $P_1$ and $P_2$, and rolling on each other without slip via internal contact, $|O_1O_2|$ indicating the distance E between the axes of the crank shaft.

Machines satisfying those characteristics may be grouped into four families depending on the nature of the element whose shape is defined by $P_1$, and depending on the comparative values of the radii $R_1$ and $R_2$. The following should be distinguished:

machines for which $P_1$ is the outline of the piston and $P_2$ is the outline of the casing, which outline corresponds to the outer envelope of $P_1$ in the orbital motion of $P_1$ relative to $P_2$, for which $R_1=S_pE$ and $R_2=S_cE=(S_p+1)E$ (family I);

machines for which $P_1$ is the outline of the piston and $P_2$ is the outline of the casing, which outline corresponds to the outer envelope of $P_1$ in the orbital motion of $P_1$ relative to $P_2$, for which $R_1=S_pE$ and $R_2=S_cE=(S_p-1)E$ (family II);

machines for which $P_1$ is the outline of the casing and $P_2$ is the outline of the piston, which outline corresponds to the inner envelope of $P_1$ in the orbital motion of $P_1$ relative to $P_2$, for which $R_2=S_pE$ and $R_1=S_cE=(S_p-1)E$ where $S_p>1$ (family III); and machines for which $P_1$ is the outline of the casing and $P_2$ is the outline of the piston, which outline corresponds to the inner envelope of $P_1$ in the orbital motion of $P_1$ relative to $P_2$, for which $R_2=S_pE$ and $R_1=S_cE=(S_p+1)E$ (family IV).

Other machines may be derived from machines belonging to any one of the four preceding families. An outline $P_2$ may be used, having at least one portion corresponding to the envelope $P_1$ in its motion relative to $P_2$, and at least one portion outside the envelope in the case of families I or II, and inside the envelope in the case of families III or IV, the various portions connecting together to define a closed curve.

The outlines of the piston and of the casing of such a machine offer the advantage of being machinable by mass-production machines (lathe-type machines), and this reduces the cost of the piston and of the casing.

The orbital motion of such machines may be achieved, either by internal gearing having parallel axes, the gear wheels being respectively secured to the piston and to the casing, and having respective pitch radii that are equal to $R_1$ and $R_2$, or else if the geometrical shapes of those surfaces of the piston and of the casing which are in contact with each other enables sufficient throughput, and if the fluid conveyed by the machine is sufficiently lubricating, then the gearing may be omitted and the relative orbital motion is directly imparted by means of the piston-casing contact when the crank shaft is being rotated.

However, which such a system for generating orbital motion, the machine suffers from the drawback of not being entirely dry, because it requires the presence of gearing to achieve the orbital motion, which gearing must therefore be lubricated to enable long-lasting operation, or else the presence of a pumped lubricating fluid if the gear is omitted and if the orbital motion is directly obtained by means of direct contact between the piston and the casing. In certain applications for which the vacuum must be very clean, this is incompatible.

OBJECTS AND SUMMARY OF THE INVENTION

An object of the present invention is to provide a machine as described above, but that further enables lubricant to be omitted from the means used to generate the orbital motion of the machine.

The invention therefore provides a positive-displacement machine comprising a cylindrical piston which has an axis Δp, which is rotary, and which is situated in a cylindrical casing which has an axis Δc, wherein, in a plane perpendicular to its axis Δp, said piston has a cross-section that is hypertrochoidal in geometrical shape and that has $S_p$ axes of symmetry, said casing delimiting a hollow volume whose cross-section in a plane perpendicular to its axis Δc is hypertrochoidal in geometrical shape and has $S_c$ axes of symmetry, $S_p$ and $S_c$ differing from each other by unity, the axes Δp and Δc being parallel and separated by a distance E, said piston being mounted to rotate freely about its axis Δp, on a crank pin that has an axis Δp, and that is secured to a shaft having an axis Δc and supported by said casing, said shaft being designed to be rotated about its axis Δc by drive means, the piston and the casing delimiting at least three chambers between them, and the casing including at least one suction inlet and one delivery outlet, and wherein the rotation of the piston in its orbital motion about the axis Δc of the casing is created by magnetic repulsion forces by means of permanent magnets situated firstly on or in the vicinity of the surface of the piston, and secondly on or in the vicinity of the inside surface of said casing.

The invention also provides a positive-displacement machine comprising a cylindrical piston which has an axis Δp, and which is situated in a cylindrical casing which has an axis Δc, wherein, in a plane perpendicular to its axis Δp, said piston has a cross-section that is hypertrochoidal in geometrical shape and that has $S_p$ axes of symmetry, said casing delimiting a hollow volume whose cross-section in a plane perpendicular to its axis Δc is hypertrochoidal in geometrical shape and has $S_c$ axes of symmetry, $S_p$ and $S_c$ differing from each other by unity, the axes Δp and Δc being parallel and separated by a distance E, and wherein said casing is mounted to rotate freely about its axis Δc, on a crank pin that has an axis Δc, and that is secured to a shaft having an axis Δp and supported by bearings in a box enclosing said casing, said box having a circularly cylindrical recess that has an axis Δp and that is large enough to enable the crank pin to rotate freely about the axis Δp of said shaft and to enable said casing to rotate in orbital motion about the axis Δp, said casing being open over a side face, and said piston being coupled to said box at said side face with no freedom of movement, said shaft being designed to be rotated about its axis Δp by drive means, the rotation of the casing in its orbital motion about the axis Δp of the piston being created by magnetic repulsion forces by means of permanent magnets situated firstly on or in the vicinity of the surface of the piston, and secondly on or in the vicinity of the inside surface of said casing, the piston and the casing delimiting at least three chambers between them, a side face of said box including at least one suction inlet and one delivery outlet in at least one of said chambers.

BRIEF DESCRIPTION OF THE DRAWINGS

The invention is described below with reference to the accompanying drawings, in which:

FIG. 12 is a section on XII—XII of FIG. 11.

DETAILED DESCRIPTION OF THE PREFERRED EMBODIMENT

The following description given with reference to the above-listed figures relates to a particularly advantageous group of machine outlines belonging to the above-defined family I and whose piston outlines $P_1$ satisfy the following equation in the complex plane:

$$Z_1 = \frac{1+S}{2} E \cdot e^{i\frac{k}{S}(1-S)} + R_m e^{i\frac{k}{S}} + \frac{1-S}{2} E \cdot e^{i\frac{k}{S}(1+S)}$$

in which equation, $Z_1$ designates the complex number designating the generator point of the outline $P_1$, each point being indicated by a particular value of the dynamic parameter k which varies over the range 0 to $2S\pi$ for a single pass along the curve, S is an integer which designates the order of symmetry of $P_1$ about the origin of the complex plane, and it is chosen arbitrarily, and E and $R_m$ are two lengths chosen freely providing that the corresponding curve has no crunodes and no cusps, thereby indirectly limiting the value of the ratio $E/R_m$.

One of the advantages of these machines is that, when the outline $P_1$ of the piston satisfies the above equation, the outline $P_2$ of the casing, which is the envelope of $P_1$ in the relative orbital motion, also satisfies that equation.

Figure 1:
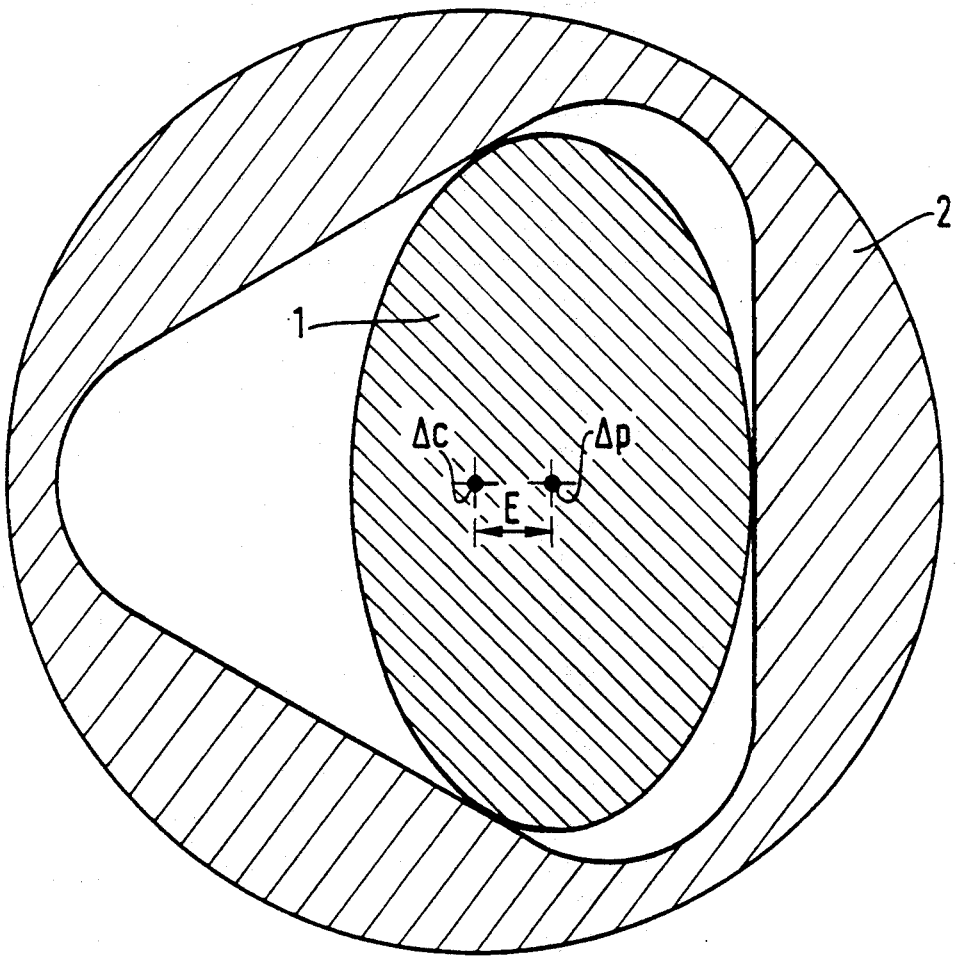
FIGS. 1, 2, and 3 show three possible piston and casing outlines of the invention.

FIG. 1 is a section through a piston and a casing on a plane that is perpendicular to the respective parallel axes Δp and Δc of the piston 1 and of the casing 2, showing the outlines of the piston and of the casing.

The outlines, $P_1$ for the piston 1 and $P_2$ for the casing 2, satisfy the above equation, with a piston 1 having an order of symmetry $S_p=2$ and a casing having an order of symmetry $S_c=3$. E is the distance between the axes Δp and Δc.

Figure 2:
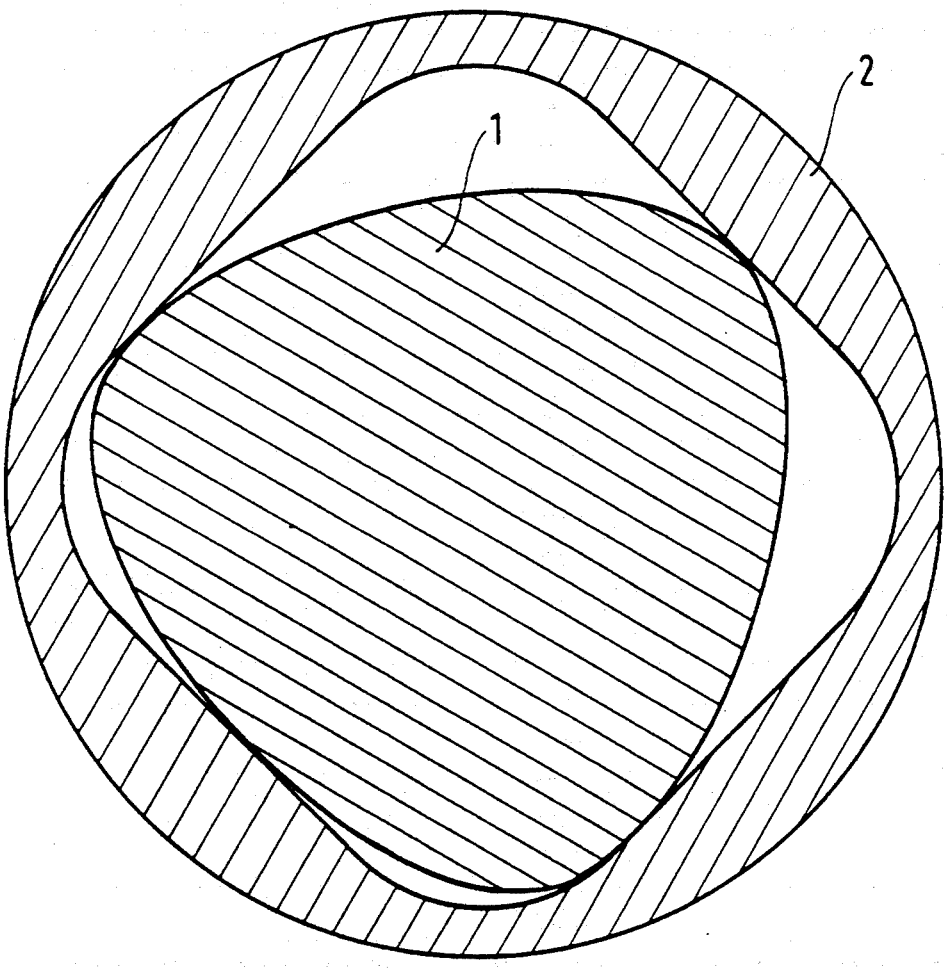

FIG. 2 is a view similar to that of FIG. 1, but in the case where the piston has an order of symmetry $S_p=3$ and the casing 2 has an order of symmetry $S_c=4$.

Figure 3:
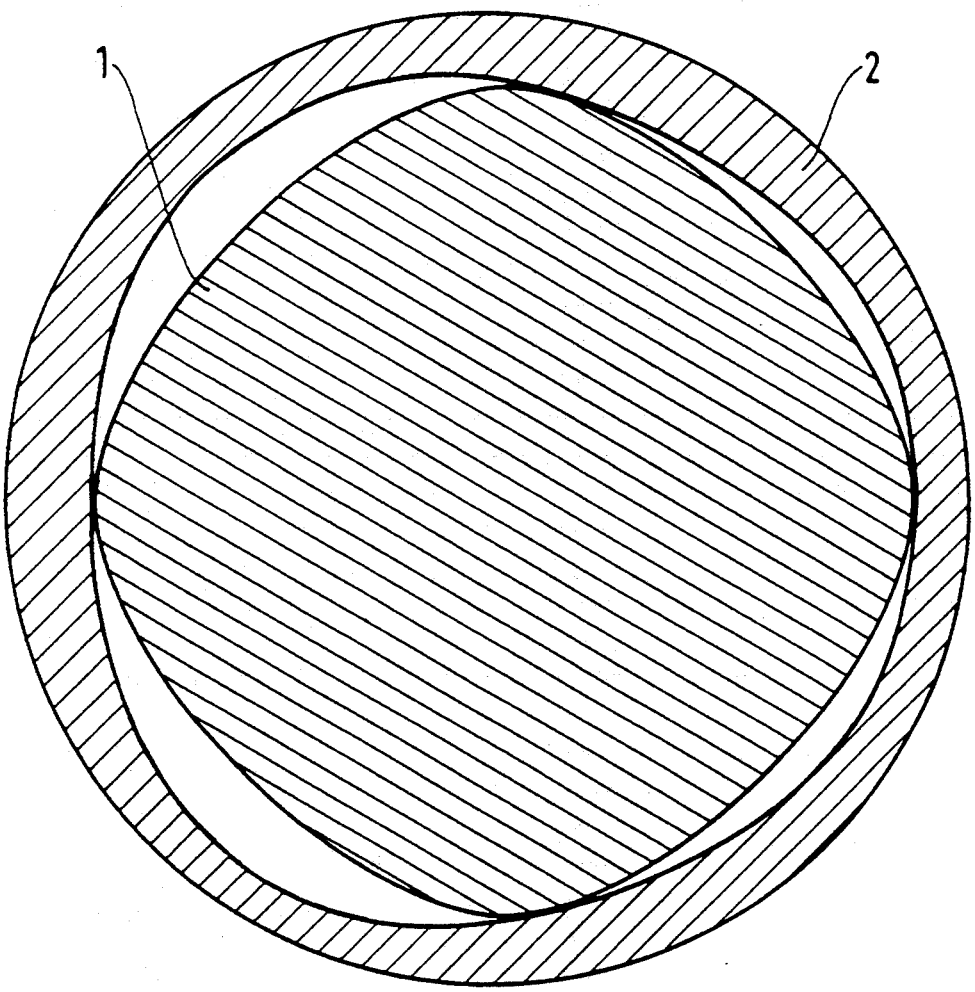

FIG. 3 shows another example in which the piston 1 has an order of symmetry $S_p=4$ and the casing 2 has an order of symmetry $S_c=3$.

It should be noted that the number of axes of symmetry is equal to the order of symmetry.

Those three figures correspond to piston and casing outlines satisfying the above equation.

In the machines of the invention shown in the following figures, given by way of non-limiting example, a piston having two axes of symmetry $S_p=2$ and a casing having three axes of symmetry $S_c=3$ have been chosen.

Figure 4:
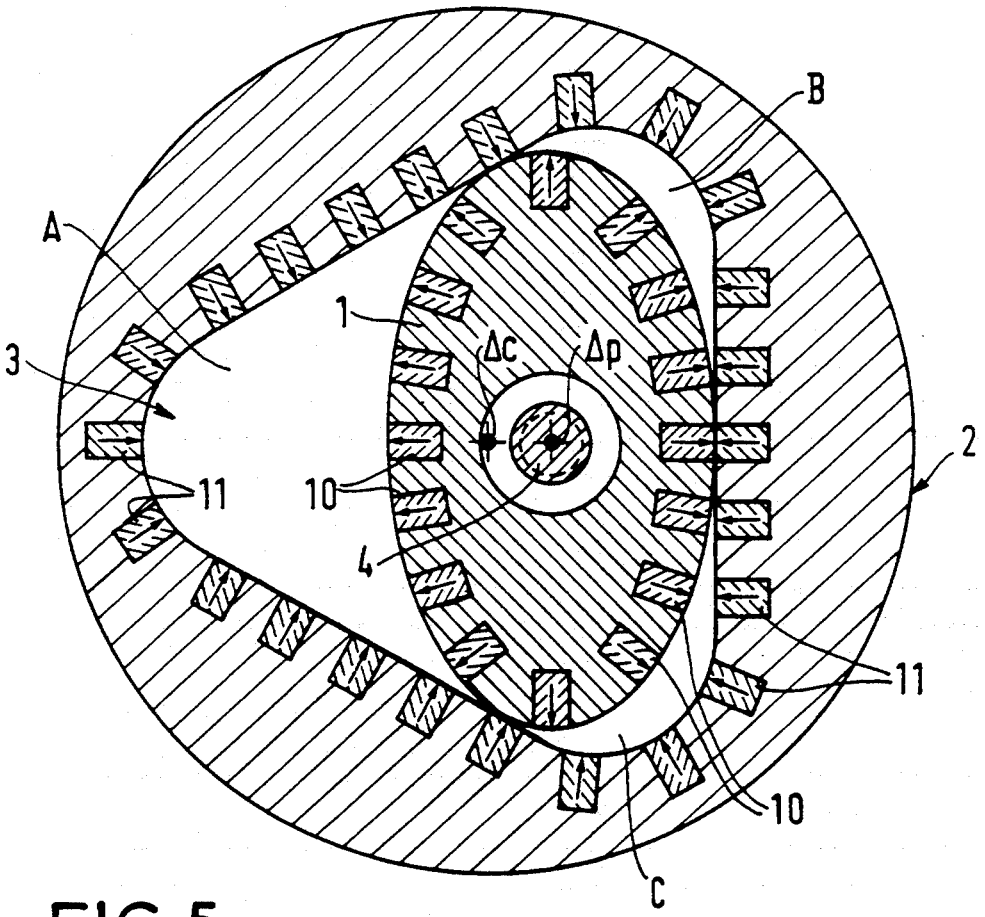
FIGS. 4 and 5 are two diagrammatic views of a machine of the invention with piston and casing outlines as shown in FIG. 1.
Figure 5:
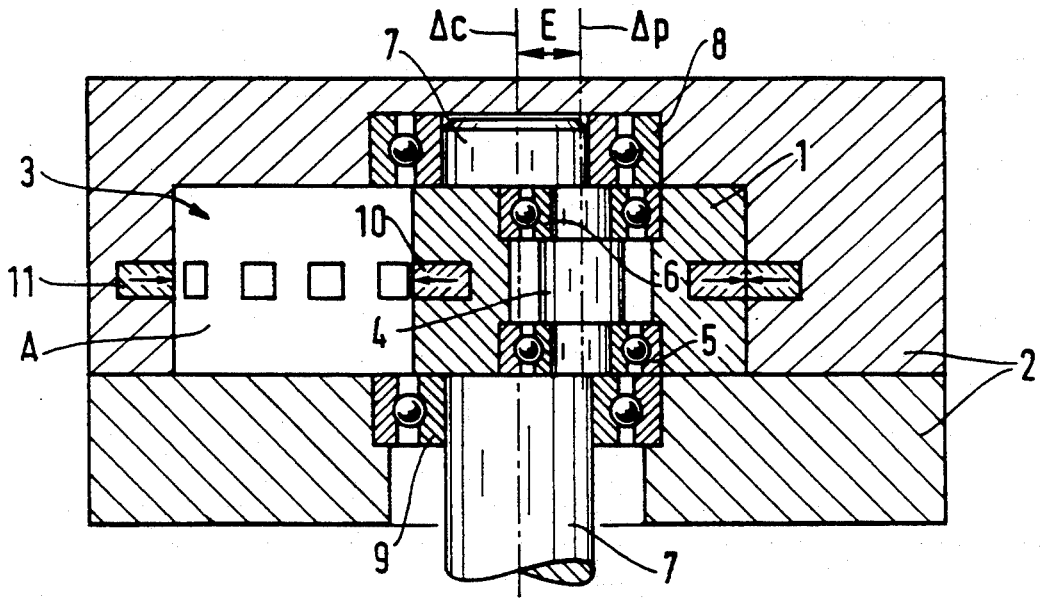
Figure 13:
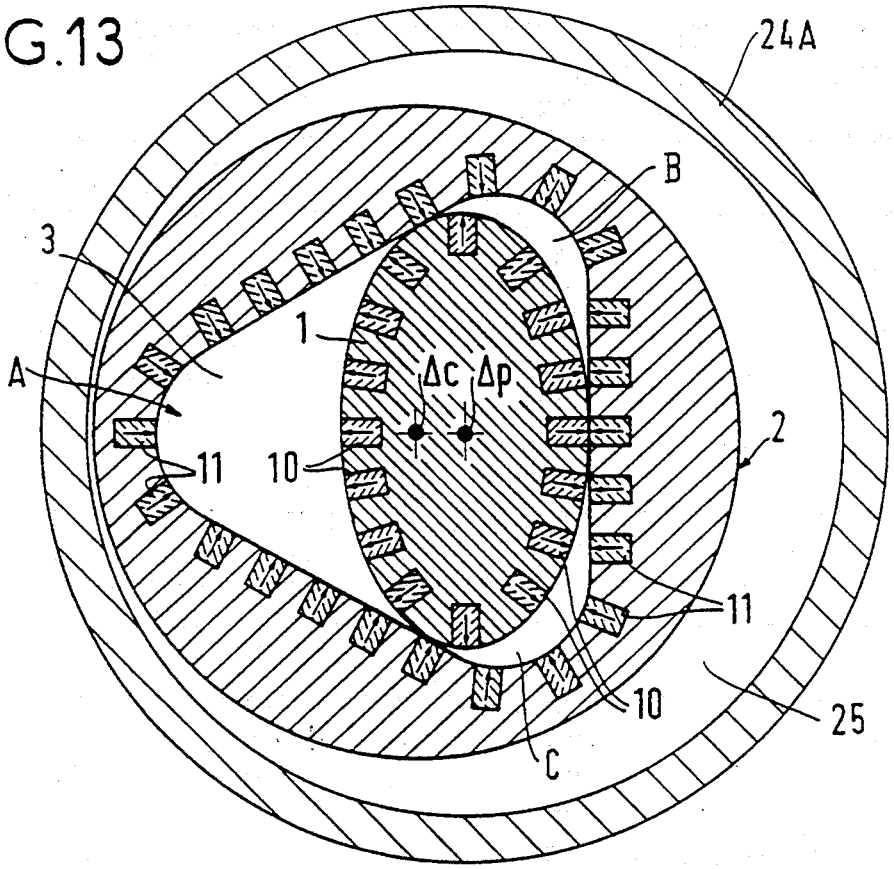
FIGS. 13 and 14 show another embodiment of a machine of the invention, corresponding to the outlines of FIG. 1, but in which the piston is fixed, and in which it is the casing which rotates in orbital motion about the axis of the piston.
Figure 14:
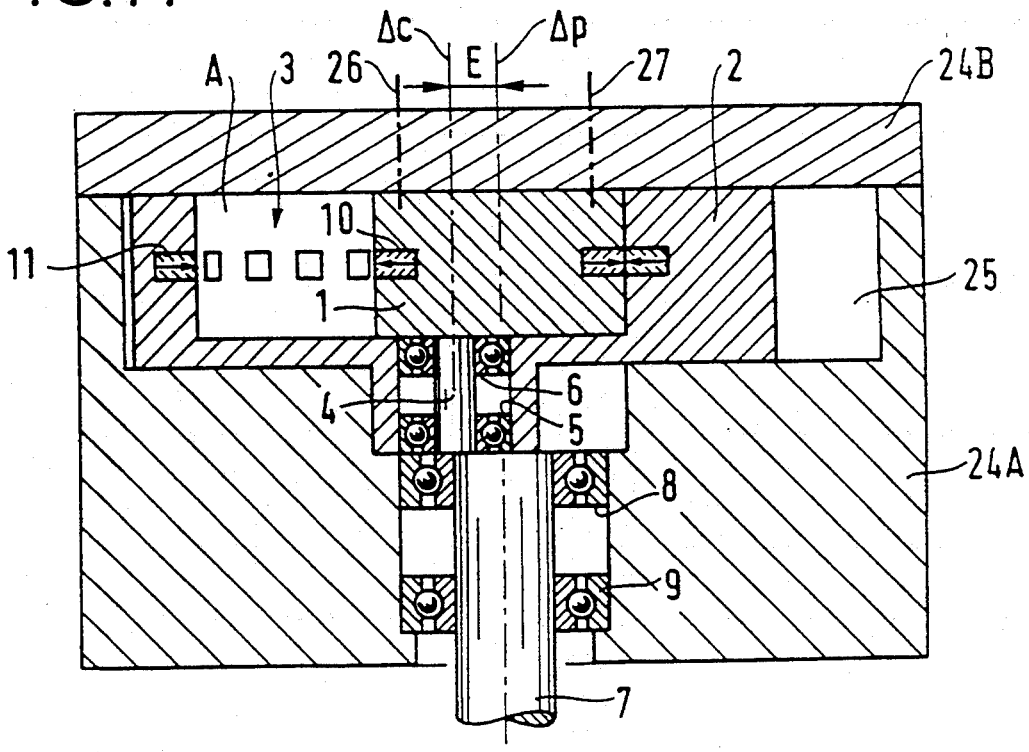

A machine of the invention is described below with reference to FIGS. 4 and 5. These figures are simplified and, in particular, they do not include the inlets and the outlets which are shown in FIGS. 11 to 14 only. FIGS. 4 and 5, as well as FIGS. 6 to 9 which are also simplified, make it possible to understand the operation of the machine of the invention, and in particular the production of the relative orbital motion: either of the piston (FIGS. 4 to 12) or of the casing (FIGS. 13 and 14).

FIGS. 4 and 5 show a positive-displacement machine of the invention including a piston 1 having an outline $P_1$ corresponding to the equation given above, and having two axes of symmetry: $S_p=2$. The piston is cylindrical, has an axis Δp, and is situated in a cylindrical casing 2 having an axis Δc. The casing 2 delimits a hollow cylindrical volume 3 whose cross-section has an outline $P_2$ also corresponding to the above equation, and having three axes of symmetry: $S_c=3$. The outlines $P_1$ and $P_2$ are hypertrochoidal outlines. The axes Δp and Δc are parallel and are separated by a distance E.

The piston 1 is mounted to rotate freely about its axis Δp on a crank pin 4 via bearings 5 and 6. The crank pin 4 is secured to a shaft 7 having an axis Δc and supported by the casing 2 via bearings 8 and 9.

The shaft 7 is rotated about its axis Δc by a motor (not shown). During the rotation, the axis Δp of the crank pin 4, i.e. of the piston 1, rotates about the axis Δc. The rotation of the piston 1 in orbital motion is caused by magnetic repulsion forces by means of permanent magnets situated firstly on the surface of the piston 1, and secondly on the inside surface of the casing 2.

In the example shown in FIGS. 4 and 5, there are a plurality of magnets 10 on the piston and a plurality of magnets 11 on the casing. In this example, the magnets are polarized substantially radially, and such that the poles at the surface of the piston are the same as the poles at the surface of the casing so as to produce the repulsion forces.

In this way, when the shaft 7 is rotated about its axis Δc by drive means, it is the magnetic repulsion forces of the magnets which cause the additional rotation of the piston about its own axis so as to complete the rotation of the piston in orbital motion about the axis Δc of the casing.

In this way, by means of the magnetic repulsion forces, the piston is positioned relative to the casing, without being in contact therewith. Therefore, no lubricant is necessary. The magnetic forces guide the piston when it is rotated by the crank pin, and they rotate it about its own axis Δp.

The piston 1 and the casing 2 delimit three chambers A, B, and C, each of which increases and decreases alternately during the rotation of the piston in orbital motion. Each chamber is provided with a suction inlet and a delivery outlet that are equipped with valves. The inlets and the outlets are shown on FIGS. 11 to 14 only.

Figure 6:
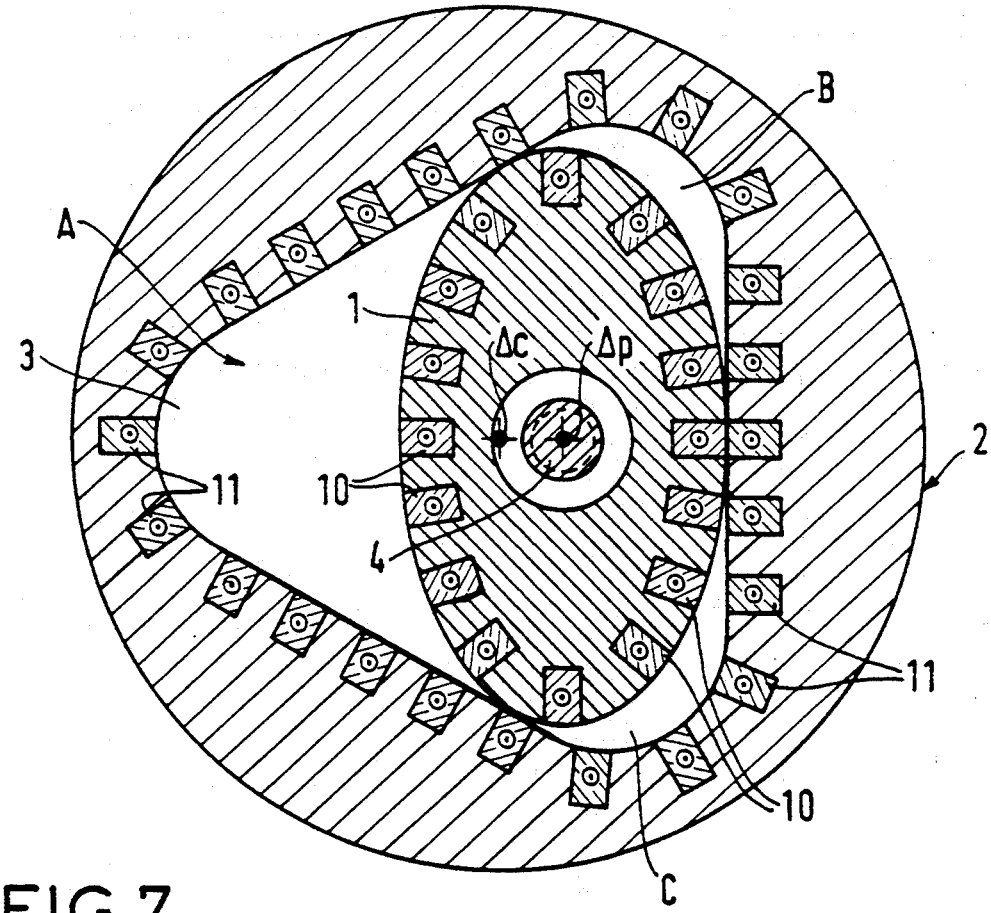
FIGS. 6 and 7 are two views that are similar to FIGS. 4 and 5 and that show a variant.
Figure 7:
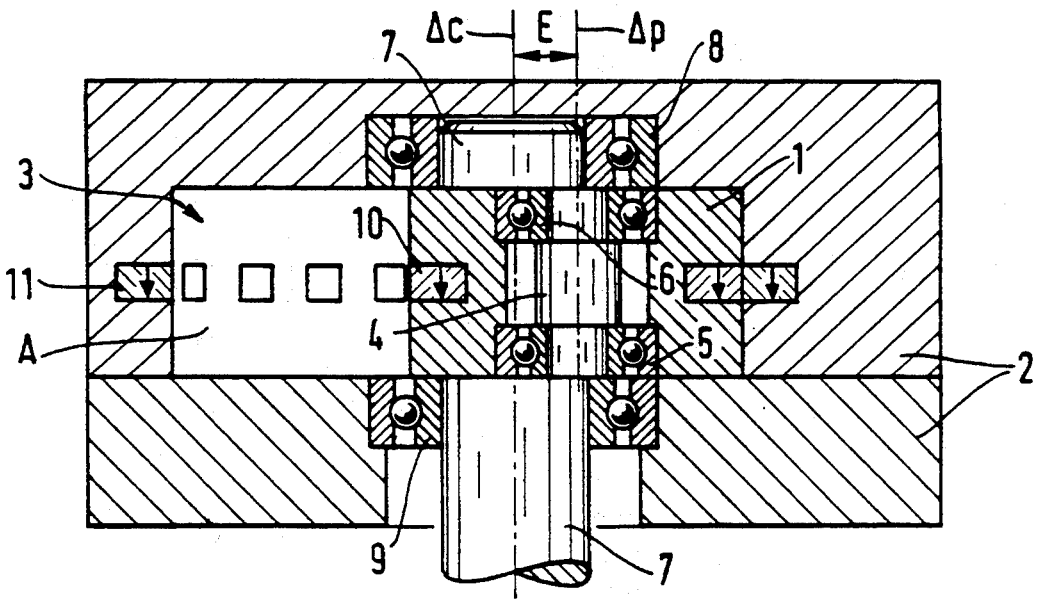

FIGS. 6 and 7 show an embodiment in which the permanent magnets are polarized axially, in the same direction on the piston and on the casing so as to obtain repulsion forces.

Figure 8:
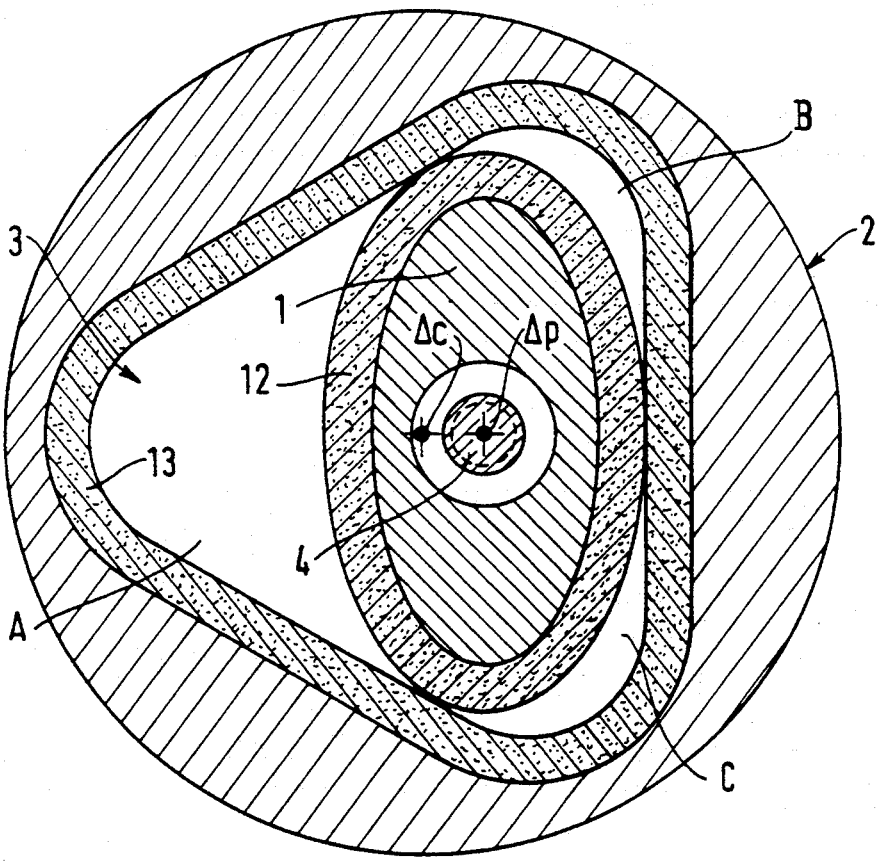
FIGS. 8 and 9 are also two views that are similar to FIGS. 4 and 5, and that show another variant.
Figure 9:
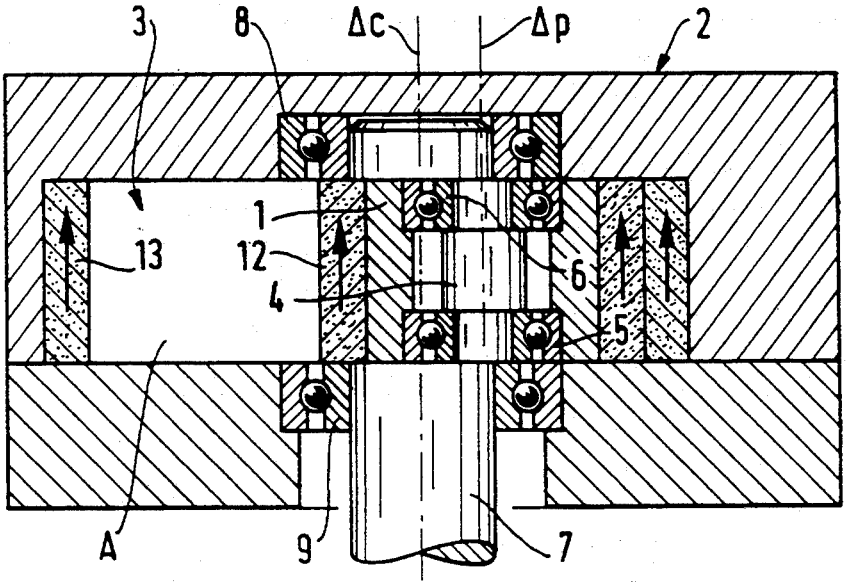

FIGS. 8 and 9 show another embodiment in which the magnets 10 and 11 are replaced with magnetized bands 12 and 13 which are magnetized axially. The bands may also be magnetized radially. The magnetized bands 12 and 13 may be glued to the respective surfaces of the piston 1 and of the casing 2.

Figure 10:
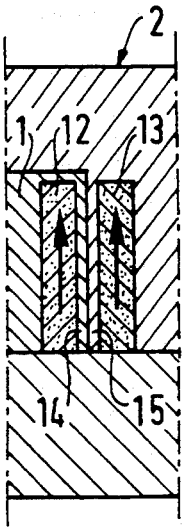
FIG. 10 is a view of a detail showing a variant of FIGS. 8 and 9.

As shown in FIG. 10, which is a fragmentary section view showing a variant, instead of securing the magnetized bands 12 and 13 directly to the surfaces of the piston and of the casing, it is possible to mold the magnetizable material containing a plastic binder. In which case, the magnetized bands 12 and 13 are not directly at the surfaces. Instead they are a little below the surfaces, because respective molds need to be formed to hold the magnetizable material. Therefore, respective thin walls 14 and 15 remain in the piston and in the casing, which walls separate the two magnetic bands 12 and 13.

Compared with using a plurality of magnets, as shown in FIGS. 4 to 7, using magnetic bands improves the distribution and the uniformness of the magnetic repulsion forces.

Figure 11:
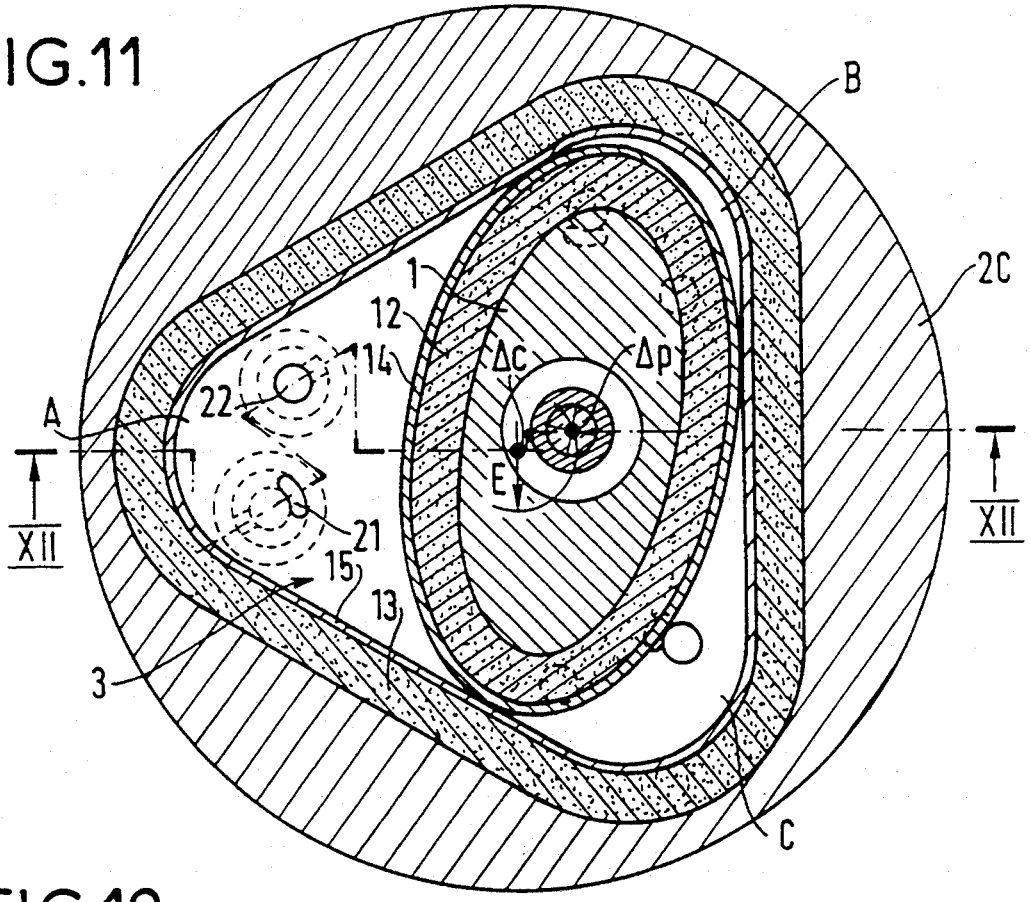
FIGS. 11 and 12 show a physical embodiment of a machine of the invention, with outlines as shown in FIG. 1, and in accordance with the FIG. 10 variant.
Figure 12:
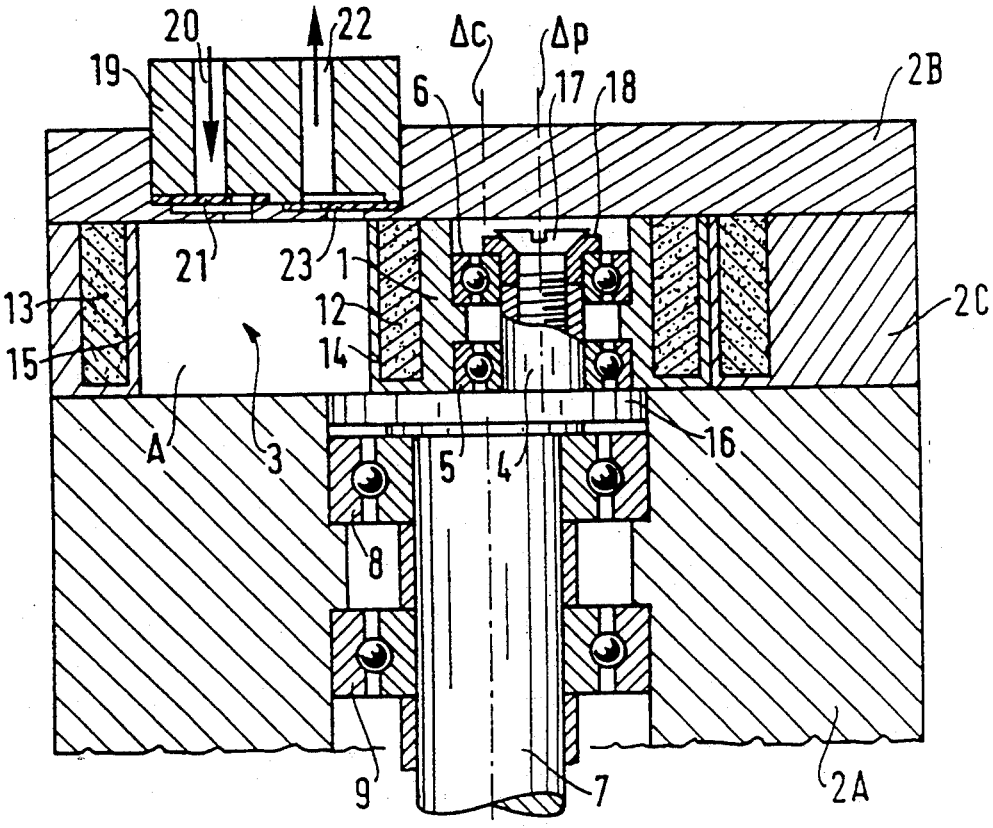

FIGS. 11 and 12 show a machine more concretely than the preceding figures, with its inlets and its outlets, and in the case where the magnetic forces are created by two magnetic bands 12 and 13 which have been cast as shown in FIG. 10.

In FIGS. 11 and 12, the piston 1 is mounted via bearings 5 and 6 on the crank pin 4 which is coupled to a disk 16 itself secured to the shaft 7 which supports the resulting assembly, so that it projects therefrom, via bearings 8 and 9 mounted in portion 2A of the casing 2 which is made up of three portions 2A, 2B, and 2C. The piston 1 is retained by a screw 17 and a washer 18.

The machine includes three independent pumping chambers A, B, and C, each of which pumps like a heart, and each of which includes an input and output block 19 comprising a suction inlet 20 equipped with a valve 21, and a delivery outlet 22 equipped with a valve 23.

In this example, in which two axially-polarized magnetic bands are used, the magnetic repulsion forces which angularly position the piston relative to the casing axially generate a point of unstable equilibrium. The piston is then axially positioned as follows: the two magnetic bands 12, and 13 are very slightly offset axially relative to each other, relative to their position of unstable equilibrium, so that an axial force is obtained in a determined direction, which force is then taken up by mounting the bearings so that they are pre-stressed.

An advantage of the configuration comprising the outline $P_1$ with an order of symmetry Sp=2, and the outline $P_2$ with an order of symmetry Sc=3 is that the outline $P_2$ of the casing is constituted by three straight line segments and three closing arcs. Another advantage is that this machine has three independent work chambers having dead volumes that are theoretically zero.

Except for the respective magnetic bands 12 and 13, the piston 1 and the three portions 2A, 2B, and 2C of the casing 2 are made of a non-magnetic material, e.g. aluminum, so as not to disturb the magnetic fields which position the piston relative to the casing.

Finally, FIGS. 13 and 14 show an embodiment in which the piston 1 is fixed, and in which the casing 2 rotates in orbital motion about the fixed axis Δp of the fixed piston 1. In this embodiment, the magnetic repulsion forces are created by a plurality of radially-polarized permanent magnets 10 and 11, as shown in FIGS. 4 and 5. Naturally, axially-polarized magnets, or two magnetic bands that are polarized axially or radially may be used.

In this embodiment, the casing 2 is mounted to rotate freely about its axis Δc on the crank pin 4 coupled to the shaft 7 whose axis Δp is coaxial with the axis Δp of the fixed piston 1. The shaft 7 is supported by bearings 8 and 9 mounted in a fixed box made up of two portions 24A and 24B. The box 24A and 24B encloses the casing 2 in a circularly cylindrical recess 25 having an axis Δp, and being large enough to enable the casing 2 to rotate in orbital motion about the axis Δp of the piston, with clearance that is sufficient to avoid any contact.

In this embodiment, the casing 2 housed in the box 24A–24B, is open over a side face, and portion 24B of the box encloses the casing 2, the piston 1 being fixed to portion 24B by screws having respective axes 26 and 27.

As in the preceding embodiments, there are three independent chambers A, B, and C, each of which has an inlet and an outlet. The same references designate the same members as in the preceding figures.

We claim:

1. A positive-displacement machine comprising a cylindrical piston which has an axis Δp, which is rotary, and which is situated in a cylindrical casing which has an axis Δc, wherein, in a plane perpendicular to its axis Δp, said piston has a cross-section that is hypertrochoidal in geometrical shape and that has $S_p$ axes of symmetry, said casing delimiting a hollow volume whose cross-section in a plane perpendicular to its axis Δc is hypertrochoidal in geometrical shape and has $S_c$ axes of symmetry, $S_p$ and $S_c$ differing from each other by unity, the axes Δp and Δc being parallel and separated by a distance E, said piston being mounted to rotate freely about its axis Δp, on a crank pin that has an axis Δp, and that is secured to a shaft having an axis Δc and supported by said casing, said shaft being designed to be rotated about its axis Δc by drive means, the piston and the casing delimiting at least three chambers between them, and the casing including at least one suction inlet and one delivery outlet, and wherein the rotation of the piston in its orbital motion about the axis Δc of the casing is created by magnetic repulsion forces by means of permanent magnets situated firstly on the surface of the piston, and secondly on the inside surface of said casing.

2. A positive-displacement machine according to claim 1, wherein said permanent magnets are axially polarized.

3. A positive-displacement machine according to claim 1, wherein said permanent magnets are radially polarized.

4. A positive-displacement machine according to claim 1, wherein said permanent magnets comprise a plurality of magnets on the surface of the piston and a plurality of magnets on the inside surface of the casing.

5. A positive-displacement machine according to claim 1, wherein said permanent magnets comprise magnetic bands carried by said piston and said casing.

6. A positive-displacement machine comprising a cylindrical piston which has an axis Δp, and which is situated in a cylindrical casing which has an axis Δc, wherein, in a plane perpendicular to its axis Δp, said piston has a cross-section that is hypertrochoidal in geometrical shape and that has $S_p$ axes of symmetry, said casing delimiting a hollow volume whose cross-section in a plane perpendicular to its axis Δc is hypertrochoidal in geometrical shape and has $S_c$ axes of symmetry, $S_p$ and $S_c$ differing from each other by unity, the axes Δp and Δc being parallel and separated by a distance E, and wherein said casing is mounted to rotate freely about its axis Δc, on a crank pin that has an axis Δc, and that is secured to a shaft having an axis Δp and supported by bearings in a box enclosing said casing, said box having a circularly cylindrical recess that has an axis Δp and that is large enough to enable the crank pin to rotate freely about the axis Δp of said shaft and to enable said casing to rotate in orbital motion about the axis Δp, said casing being open over a side face, and said piston being coupled to said box at said side face with no freedom of movement, said shaft being designed to be rotated about its axis Δp by drive means, the rotation of the casing in its orbital motion about the axis Δp of the piston being created by magnetic repulsion forces by means of permanent magnets situated firstly on the surface of the piston, and secondly on or in the vicinity of the inside surface of said casing, the piston and the casing delimiting at least three chambers between them, a side face of said box including at least one suction inlet and one delivery outlet communicating with each other in at least one of said chambers.

7. A positive-displacement machine according to claim 6, wherein said permanent magnets are axially polarized.

8. A positive-displacement machine according to claim 6, wherein said permanent magnets are radially polarized.

9. A positive-displacement machine according to claim 2, wherein said permanent magnets comprise a plurality of magnets on the surface of the piston and a plurality of magnets on the inside surface of the casing.

10. A positive-displacement machine according to claim 2, wherein said permanent magnets comprise magnetic bands carried by said piston and said casing.

11. A positive-displacement machine comprising a cylindrical piston which has an axis Δp, which is rotary, and which is situated in a cylindrical casing which has an axis Δc, wherein, in a plane perpendicular to its axis Δp, said piston has a cross-section that is hypertrochoidal in geometrical shape and that has Sp axes of symmetry, said casing delimiting a hollow volume whose cross-section in a plane perpendicular to its axis Δc is hypertrochoidal in geometrical shape and has Sc axes of symmetry, Sp and Sc differing from each other by unity, the axes Δp and Δc being parallel and separated by a distance E, said piston being mounted to rotate freely about its axis Δp, on a crank pin that has an axis Δp, and that is secured to a shaft having an axis Δc and supported by said casing, said shaft being designed to be rotated about its axis Δc by drive means, the piston and the casing delimiting at least three chambers between them, and the casing including at least one suction inlet and one delivery outlet, and wherein the rotation of the piston in its orbital motion about the axis Δc of the casing is created by magnetic repulsion forces by means of permanent magnets situated firstly in a vicinity of the surface of the piston, and secondly in a vicinity of the inside surface of said casing.

12. A positive-displacement machine according to claim 11, wherein said permanent magnets are axially polarized.

13. A positive-displacement machine according to claim 11, wherein said permanent magnets are radially polarized.

14. A positive-displacement machine according to claim 11, wherein said permanent magnets comprise a plurality of magnets on the piston and a plurality of magnets on the casing.

15. A positive-displacement machine according to claim 11, wherein said permanent magnets comprise magnetic bands carried by said piston and said casing.

16. A positive-displacement machine comprising a cylindrical piston which has an axis Δp, and which is situated in a cylindrical casing which has an axis Δc, wherein, in a plane perpendicular to its axis Δp, said piston has a cross-section that is hypertrochoidal in geometrical shape and that has Sp axes of symmetry, said casing delimiting a hollow volume whose cross-section in a plane perpendicular to its axis Δc is hypertrochoidal in geometrical shape and has Sc axes of symmetry, Sp and Sc differing from each other by unity, the axes Δp and Δc being parallel and separated by a distance E, and wherein said casing is mounted to rotate freely about its axis Δc, on a crank pin that has an axis Δc, and that is secured to a shaft having an axis Δp and supported by bearings in a box enclosing said casing, said box having a circularly cylindrical recess that has an axis Δp and that is large enough to enable the crank pin to rotate freely about the axis Δp of said shaft and to enable said casing to rotate in orbital motion about the axis Δp, said casing being open over a side face, and said piston being coupled to said box at said side face with no freedom of movement, said shaft being designed to be rotated about its axis Δp by drive means, the rotation of the casing in its orbital motion about the axis Δp of the piston being created by magnetic repulsion forces by means of permanent magnets situated firstly in a vicinity of the surface of the piston, and secondly in the vicinity of the inside surface of said casing, the piston and the casing delimiting at least three chambers between them, a side face of said box including at least one suction inlet and one delivery outlet communicating with each other in at least one of said chambers.

17. A positive-displacement machine according to claim 16, wherein said permanent magnets are axially polarized.

18. A positive-displacement machine according to claim 16, wherein said permanent magnets are radially polarized.

19. A positive-displacement machine according to claim 16, wherein said permanent magnets comprise a plurality of magnets on the piston and a plurality of magnets on the casing.

20. A positive-displacement machine according to claim 16, wherein said permanent magnets comprise magnetic bands carried by said piston and said casing.

* * * * *